US005481982A

United States Patent [19]

Theurer et al.

[11] Patent Number: 5,481,982

[45] Date of Patent: Jan. 9, 1996

[54] TRACK SURFACING MACHINE AND METHOD FOR CORRECTING THE TRACK GEOMETRY BASED ON TRACK CANT AND MEASURED LINING FORCE

[75] Inventors: Josef Theurer, Vienna; Gernot Böck, Aschach/Donau, both of Austria

[73] Assignee: Franz Plasser Bahnbaumaschinen-Industrieges. m.b.H., Vienna, Austria

[21] Appl. No.: 335,322

[22] Filed: Nov. 7, 1994

[30] Foreign Application Priority Data

Nov. 5, 1993 [AT] Austria ..... 2246/93

[51] Int. Cl.[6] ..... E01B 29/04

[52] U.S. Cl. ..... 104/7.2; 104/8; 33/287

[58] Field of Search ..... 104/2, 7.2, 7.1, 104/8; 33/1 Q, 287

[56] References Cited

U.S. PATENT DOCUMENTS

| | | | |
|---|---|---|---|
| 3,646,503 | 2/1972 | Plasser et al. | 104/8 |
| 3,952,665 | 4/1976 | Stewart et al. | 104/8 |
| 4,655,142 | 4/1987 | Theurer et al. | 104/8 |
| 5,113,767 | 5/1992 | Theurer | 104/7.2 |
| 5,172,637 | 12/1992 | Theurer et al. | 104/7.2 |

FOREIGN PATENT DOCUMENTS 2240570 8/1991 United Kingdom .

*Primary Examiner*—Robert J. Oberleitner
*Assistant Examiner*—S. Joseph Morano
*Attorney, Agent, or Firm*—Henry M. Feiereisen

[57] ABSTRACT

A track surfacing machine for correcting the track geometry includes a machine frame supported by undercarriages for mobility in an operating direction and including lining drives for correcting the track in a direction transversely to the track and measuring carriages rolling on the track and provided with measuring instruments. The measuring carriages form with the machine frame as well as with measuring instruments a reference system for detecting the actual track geometry, with the machine frame defining a reference base. Associated with the forward and rear measuring carriages of the reference system in operating is a measuring unit for detecting a cant or lateral inclination of the track, with a pressure pickup being provided for determining the lining forces of the lining drives.

7 Claims, 2 Drawing Sheets

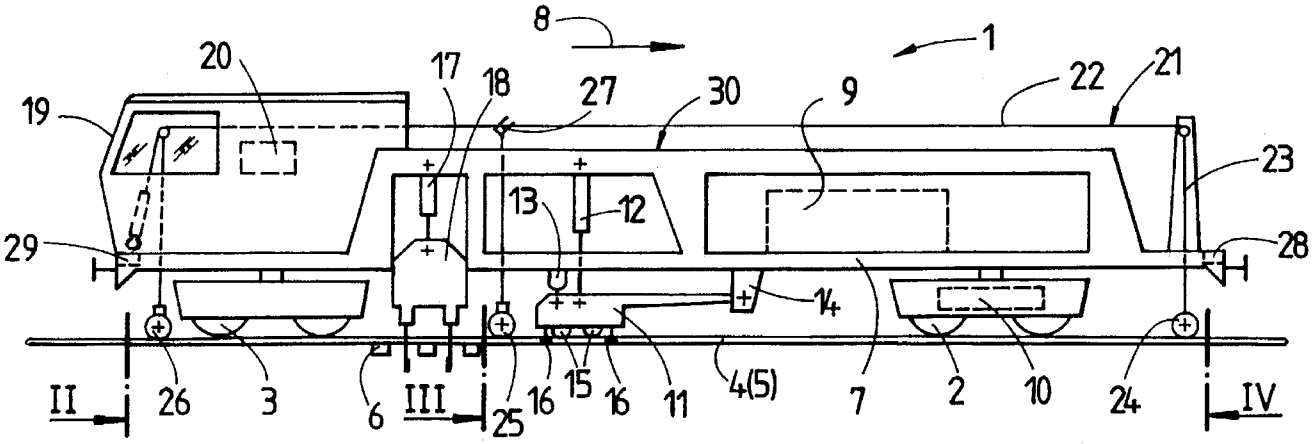
Fig. 1
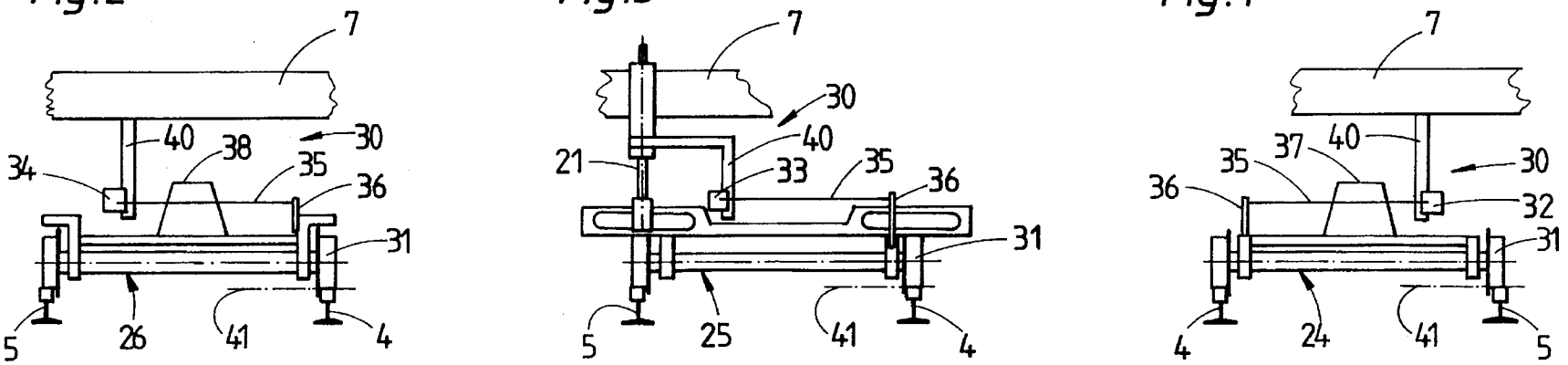
Fig. 2
Fig. 3
Fig. 4

TRACK SURFACING MACHINE AND METHOD FOR CORRECTING THE TRACK GEOMETRY BASED ON TRACK CANT AND MEASURED LINING FORCE

BACKGROUND OF THE INVENTION

The present invention refers to a track surfacing machine for correction of the track geometry, and in particular to a track surfacing machine having a machine frame supported by undercarriages for mobility in an operating direction on a track and including lining drives for correcting the track in lateral direction and measuring carriages rolling along the track and forming together with the machine frame and with measuring elements a reference system for detecting the desired track geometry, with the machine frame serving as reference base.

Austrian Pat. No. 394,742 discloses a track tamping machine for correcting the track geometry, with the machine frame being supported at its ends by undercarriages and serving as reference base of a machine-based reference system for detecting errors of the track geometry.

U.S. Pat. No. 5,113,767 describes a track stabilizer with two stabilization assemblies arranged between undercarriages. A machine-based reference system is provided to detect cross level errors and track errors in lateral direction and is essentially defined by measuring carriages, which are spaced from each other longitudinally in direction of the machine frame, and a lining and leveling chord. In accordance with another, modified embodiment, the reference base of the lining reference system may also be formed by the machine frame of the track stabilizer.

U.S. Pat. No. 5,172,637 describes a further track stabilizer with a reference system including a pendulum in the area of the forward and the central measuring carriage for detecting the track cross level. In combination with an odometer for measuring the distance traveled by the machine, the track position in transverse direction can be detected in the area of the forward measuring carriage and be used subsequently as reference basis for the second measuring carriage located in the work area of the track in order to maintain the previously determined track cross level even though the track stabilizer produces a lowering of the track.

U.S. Pat. No. 4,655,142 discloses a track tamping machine with a reference system defined by leveling and lining chords and a pendulum provided on the forward measuring carriage as well as rear measuring carriage for detecting the track cross level. The rear, second pendulum allows indication of any residual error in the desired cross level which error can be essentially eliminated through respective control of the track lifting assemblies.

SUMMARY OF THE INVENTION

It is an object of the present invention to provide an improved track surfacing machine of the above-stated type effecting a higher operating accuracy.

This object, and others which will become apparent hereinafter, are attained in accordance with the present invention by associating each measuring carriage at the leading and trailing ends of the reference system in operating direction with a measuring device for determining a lateral inclination or cant of the track, and by providing a pressure pickup for detecting the lining forces of the lining drives.

Through combining the reference system with a measurement of the lateral inclination of the track and the pressure pickup, irregularities caused by the construction and use of the machine frame as reference basis can completely be eliminated in a simple manner so that a simplified and highly accurate reference system for determining errors of the lateral track structure is created. The simplification is accomplished in particular by eliminating the use of a lining chord which interferes with movements by work assemblies in transverse direction, and by utilizing an already existing and very stable machine element, namely the machine frame, as reference basis.

Through use of measuring devices for detecting a cant of the track, inaccuracies experienced in the area of a transition curve of a track are fully compensated, while the pressure pickup counters flexures of the machine frame which may be caused through application of great lining forces and would falsify the measuring result so that even in extreme situations a high accuracy of the reference system is accomplished.

The pressure pickup is suitably linked with a measuring instrument of a measuring carriage in the area of the lining drive for enabling an automatic zero adjustment in dependence of the lining force. This reliably precludes any risk factors causing inaccuracies of the measurement.

According to another feature of the invention, the measuring instrument of each measuring carriage is respectively connected to a vertical mounting of the machine frame and formed as rotary potentiometer with a string which is secured to the associated measuring carriage at a point of attachment. Thus, the overall structure becomes very simple and ensures accurate measuring results.

Suitably all points of attachment of the strings with the measuring carriages are positioned at a same level relative to a horizontal reference plane defined by the wheel contact surface of the undercarriages. Thus, fluctuations of the machine frame will not influence in any way the accuracy of the measuring result.

The arrangement of two assemblies for measuring the lateral inclination or cant of the track has the particular advantage that measurement errors caused by a twist of the machine frame are compensated.

In accordance with a method for correction of the track geometry, the problems arising through use of the machine frame as reference base are overcome by compensating the cant of the track and the lining force for lateral displacement of the track for the zero adjustment of the measuring instruments. In addition, a twist of the machine frame may also be taken into account for the zero adjustment.

BRIEF DESCRIPTION OF THE DRAWING

The above and other objects, features and advantages of the present invention will now be described in more detail with reference to the accompanying drawing in which:

FIG. 1 is a side elevational view of a track surfacing machine according to the present invention;

FIG. 2 is a fragmentary, schematic enlarged view of the track surfacing machine taken along the line II in FIG. 1;

FIG. 3 is a fragmentary, schematic enlarged view of the track surfacing machine taken along the line III in FIG. 1;

FIG. 4 is a fragmentary, schematic enlarged view of the track surfacing machine taken along the line IV in FIG. 1;

DETAILED DESCRIPTION OF PREFERRED EMBODIMENTS

Figure 5:
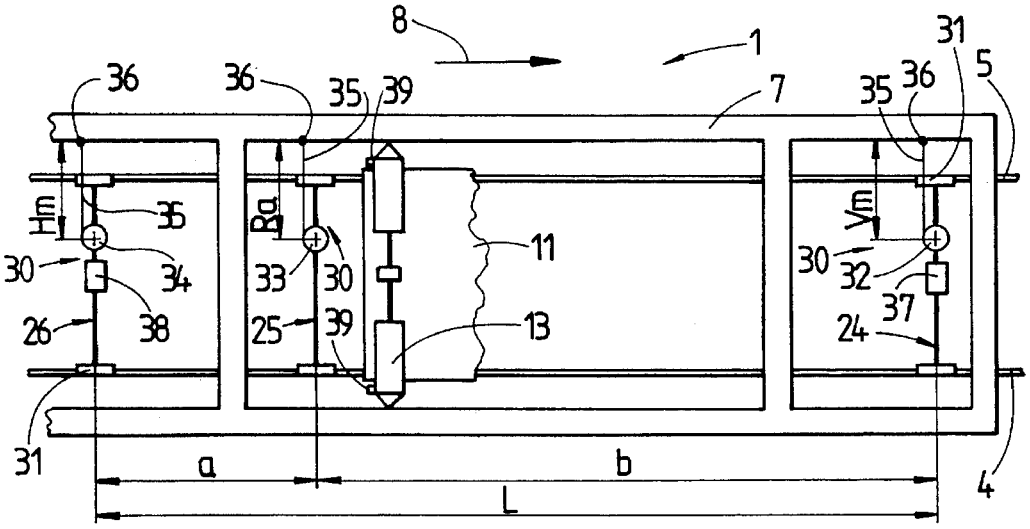
FIG. 5 is a fragmentary, schematic top view of a reference system of the track surfacing machine for correction of the track in lateral direction.

Throughout all the Figures, the same or corresponding elements are always indicated by the same reference numerals.

Turning now to the drawing, and in particular to FIG. 1, there is shown a track surfacing machine, generally designated by reference numeral 1, for correcting the geometry or alignment of a track having two rails 4, 5 fastened to ties 6. The illustrated track surfacing machine I is designed as a continuously advancing track tamping, lining and leveling machine and includes a machine frame 7 which is mounted on undercarriages 2, 3 for mobility along the track in an operating direction indicated by arrow 8. The machine frame 7 is propelled by a drive 10 which acts upon the leading undercarriage 2. A power plant 9 is mounted at the front end of the machine frame 7 to supply power to all the drives of the track surfacing machine 1.

The track surfacing machine 1 is equipped with a track lining and lifting assembly 11 which is pivotally mounted to the machine frame 7 via a hydraulic lifting unit 12 for effecting a vertical adjustment of the track and via a hydraulic lining drive 13 for effecting a lateral displacement of the track. The forward end of the assembly 11 is further linked and secured to a mounting 14 of the machine frame 7. The track lining and lifting assembly 11 is provided with track correction tools which are associated with each rail 4, 5 and include two flanged lining rollers 15 and four clamping rollers 16 which oppose each other in pairs for engaging and lifting the track on the outside and inside of the rail head of the rails 4, 5.

The track surfacing machine 1 is further equipped for each rail with a tamping unit 18 which is shown only schematically and is connected to the machine frame 7 via a hydraulic drive 17 by which the tamping unit 18 is vertically adjustable upwardly and downwardly. At its rear or trailing end, the machine frame 7 carries an operator's cab 19 which houses a control panel 20 for the track correction tools.

For determining the cross level, the track surfacing machine 1 is provided with a leveling reference system 21 which is defined by a leveling reference line 22 in form of a tensioned wire and associated with each rail 4, 5. Each reference line 22 has a forward end and a rear end in the operating direction, with each end being connected via a respective bar 23 to a measuring carriage 24 which runs along the track rails 4, 5, preferably by means of flanged wheels. Forward measuring carriage 24 supports the reference line 22 along an uncorrected track section while rear measuring carriage 26 supports the reference line 22 along a corrected track section. A further measuring carriage 25 travels, preferably by flanged wheels, along the track between the track leveling and lifting assembly 11 and the tamping unit 18. Associated with each rail 4, 5, the measuring carriage 25 is operatively connected to a measuring instrument 27 in form of a fork-shaped sensing arm which, in a conventional manner, engages the reference line 22 for generating a control signal responsive to the track cross level difference in the area of the measuring carriage 25 relative to the desired track cross level as defined by the reference line 22. The control signal as generated by the measuring instrument 27 is utilized for indirect or direct actuation of the lifting drive 12 for raising the track via the lifting rollers 16 of the track lining and lifting assembly 11 to the desired level.

The forward end as well as the rear end of the machine frame 7 is further provided with a measuring unit 28, 29 for determining a cant or lateral inclination of the track.

Turning now to FIGS. 2, 3 and 4, there are shown enlarged views of the track surfacing machine 1 in the area of the measuring carriages 24, 25, 26, and it can be seen that the machine 1 is equipped with a further reference system, generally designated by reference numeral 30, for correction of the track in lateral direction. The reference system 30 is defined essentially by the machine frame 7, which serves as reference base, the measuring carriages 24, 25, 26 which run via the flanged wheels 31 on the rails 4, 5, and measuring instruments 32, 33, 34 which are secured directly to the machine frame 7 via a respective bracket or mounting 40. Each measuring instrument 32, 33, 34 is provided in form of a rotary potentiometer with a sliding contact which is rotatable about a vertical or a horizontal axis by means of a pickup string 35. Each string 35 is secured at a point of attachment 36 directly to the associated measuring carriage 24, 25, 26. Persons skilled in the art will understand that the provision of such a potentiometer is shown by way of example only, and may be substituted by other suitable means such as for example a non-contact measuring unit.

Associated to the forward measuring carriage 24 and the rear measuring carriage 26 is a measuring unit 37, 38 for determining a cant or lateral inclination of the track. In a manner generally known per se and thus not shown in the drawing, all the measuring carriages 24, 25, 26 are pressed against one of the rails 4, 5, representing the reference rail in order to eliminate the track play.

Since the pickup strings 35 of the measuring instruments 32, 33, 34 extend by about 420 mm above the top of rail, an error of up to 8 mm would be encountered in the transition area or ramp area of a curved track because of the lateral deflection of the point of attachment 36. These errors of deflection can be eliminated by determining the tilt of the forward and rear measuring carriages 24, 26 by means of the associated measuring unit 37, 38 and including the tilt measurement for compensation of the lining assembly. With regard to the measuring carriage 25, the desired value of the superelevation for the lining reference system 21 may be taken into account.

In relation to a horizontal reference plane 41, which is defined by the wheel contact surface of the undercarriages 2,3 upon the rails 4, 5, all points of attachment 36 of the pickup strings 35 extend at a same level, i.e. they are oriented in a plane parallel to the reference plane 41. This ensures that all three points of attachment 36 undergo the same lateral deviation when the machine frame 7 is tilted. A measuring error is thus precluded also in this case.

FIG. 5 illustrates a fragmentary, schematic top view of the reference system of the track surfacing machine I in order to show various mathematical relations. In contrast to the embodiment shown in FIGS. 1 to 4, the measuring instruments 32, 33, 34 are arranged on the respective measuring carriages 24, 25, 26 while the respective pickup strings 35 are connected with the machine frame 7. This, however, does not affect the operation of the reference system 30 according to the present invention. The distances of the measuring instruments 32, 33, 34 from the machine frame 7 or point of attachment 36 in a direction transversely to the machine frame are designated as Vm (forward measuring point), Hm (rear measuring point), and Ra (alignment deviation). Reference character 'L' designates the distance of the forward measuring carriage 24 to the rear measuring carriage 26. Reference character 'a' designates the distance of the rear measuring carriage 26 to the central measuring carriage 25, while 'b' designates the distance of the forward measuring carriage 24 to the central measuring carriage 25. Thus, the following equations are obtained:

Machine-dependent system constant K= b/L

*Average of measuring value* $Mm=(Hm-Vm)\times K+Vm$

In the event, the reference system 30 is situated on a precisely straight alignment of the track (for a zero balance), the equation is as follows:

$$[(Hm-Vm)\times K+Vm]-Ra(=Mm)=0$$

The lining value (or value of displacement) Rw, necessary for executing the correction of the track laterally is defined by the following equation (with consideration of the versine h in curved tracks):

$$Rw=h-[(Hm-Vm)\times K+Vm]-Ra$$

A tilting or parallel shift of the machine frame 7 does not adversely affect the determination of the lining value since a zero balance is carried out in a basic set up in which all measuring carriages 24, 25, 26 extend in a horizontal track plane, with the rails 4, 5 forming an exact straight line. Viewed in operating direction, all measuring carriages 24, 25, 26 are pressed against the right rail 4 and the lining drives 13 are controlled without pressure. The track is e.g. imbedded in concrete and thus immovable. A first trimming potentiometer trims the indication of the lining value to read zero. Then, the left lining drive 13 is acted upon by a maximum lining force. In case of a deviation of the lining value due to a lateral flexure of the machine frame 7, a second trimming potentiometer respectively readjusts the indication to read zero. Lining forces lying between these two zero adjustments are detected by a pressure pickup 39 and linearly compensated so that the lining values are correctly indicated upon automatic compensation of the flexures of the machine frame 7 in dependence of the lining forces. The described process is to be repeated for the right lining drive 13. In case, the machine frame 7 has a too low twist stiffness, the cant measuring units 37, 38 located at the ends of the machine frame 7 detect a twist which is also taken into account when determining the lining value.

The following advantages are achieved by utilizing the reference system 30 according to the present invention for correcting the track geometry in lateral direction:

—No steel chord or light chord is utilized which would affect the working tools of the machine 1.

—In tamping machines for switches, the use of complicated chord follower controls is eliminated at the forward and rear measuring carriages.

—The tamping assemblies can be shifted beyond the track middle without danger.

—The reference system 30 can be assembled with proven, conventional mechanical and electrical components. Simple rotary measuring instruments are sufficient for determination of measuring values.

—A measuring error caused by sagging of the steel chord in ramps and curved tracks is eliminated.

Figure 6:
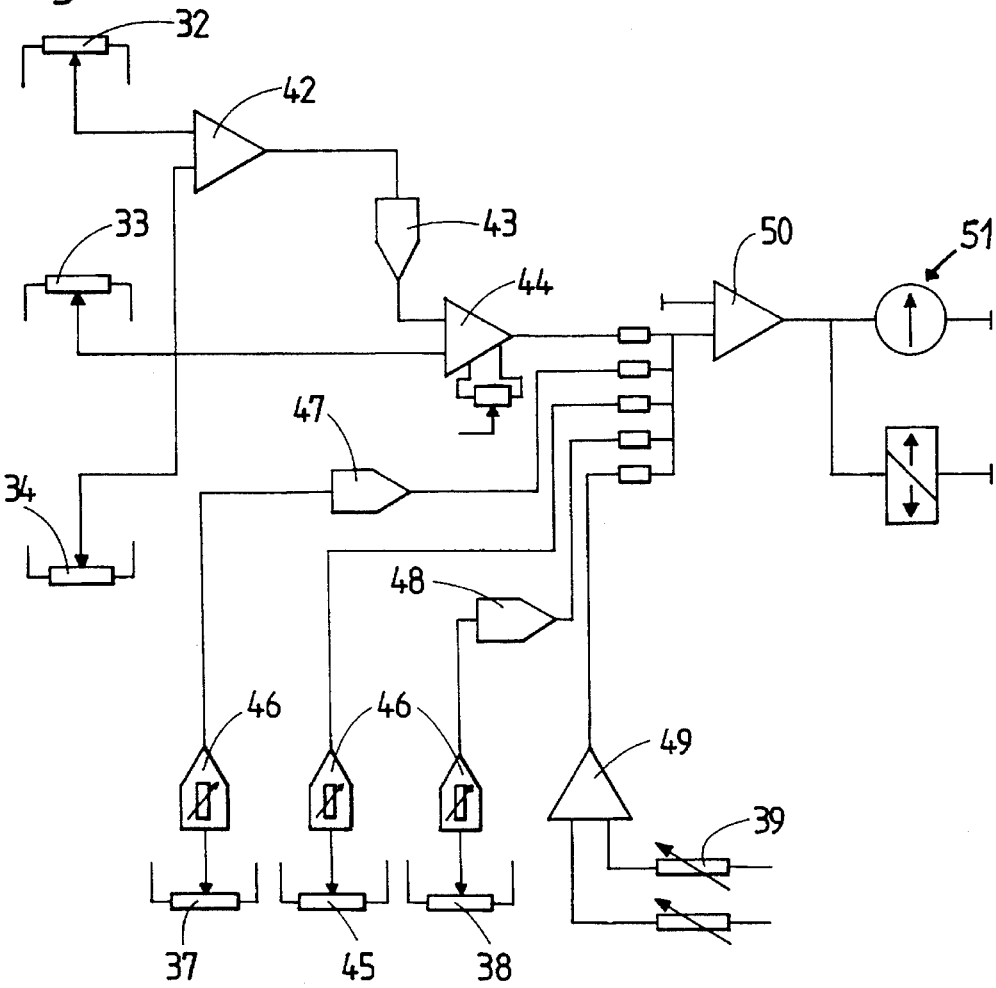
FIG. 6 is a simplified diagram of a control circuit.

Turning now to FIG. 6, there is shown a simplified diagram of a control circuit, and it can be seen that signals from the measuring instruments 32, 34 are inputted into a differential element 42 which forms the difference between the control signals of the forward and rear measuring instruments 32, 34 (Hm–Vm). The output of the differential element 42 is connected to the input of a matching element 43 which multiplies the differential value with the system constant K and sends a signal to one input of a further differential element 44 which has a second input connected to the central measuring instrument 33. The differential element 44, which effects also an overall zero adjustment, subtracts the lining deviation Ra as determined by the central measuring instrument 33. At the same time, the cant measuring units 37, 38 and an additional measuring unit 45, which is associated to the lining reference system 21, detect a respective tilt of the pertaining measuring carriages 24, 25, 26. Each measuring unit 37, 38, 45 is followed by a matching element 46 which processes the measured value in correspondence with the structure-based lateral deviation of the point of attachment 36 in dependence on the tilt of the measuring carriages 24, 25, 26. The further matching elements 47, 48 process the measured value in correspondence with the structure-based factor a/L and b/L. A further differential element 49 determines the lining force (e.g. through pressure differential). All measured values are inputted into a differential element 50 which adds and compensates the measured values and transmits a control signal to an hydraulic servo circuit, generally designated by reference numeral 51, for executing the required lateral correction of the track geometry by activating the respective lining drive 13. At a same time, the respective lining force is indicated.

Persons skilled in the art will understand that the provision of a tamping assembly 18 is shown by way of example only. It is also possible to substitute the tamping assembly for example with a conventional stabilizer assembly for use as lateral correction of the track geometry.

While the invention has been illustrated and described as embodied in a track surfacing machine and method for correcting the track geometry, it is not intended to be limited to the details shown since various modifications and structural changes may be made without departing in any way from the spirit of the present invention.

What is claimed as new and desired to be protected by Letters Patent is set forth in the appended claims:

We claim:

1. A track surfacing machine for correcting the track geometry, comprising:

a machine frame supported by undercarriages for mobility in an operating direction on a track;

a lining drive means supported on said machine frame and exerting lining forces for displacing the track in a direction transversely to the track;

a measuring means forming with said machine frame a reference system for determining the actual track geometry, with said machine frame forming a reference base, said measuring means including in the operating direction a leading measuring carriage and a trailing measuring carriage, with each measuring carriage having a measuring instrument for determining a cant of the track; and a pressure pickup for determining the lining forces of said lining drive means.

2. The machine of claim 1 wherein said measuring means includes in the area of said lining drive a further measuring carriage with a measuring instrument, said pressure pickup being linked to said measuring instrument of said further measuring carriage for effecting an automatic zero adjustment in dependence on the lining force.

3. The machine of claim 2 wherein each of said measuring instruments is provided in form of a rotary potentiometer with a pickup string, and further comprising a mounting associated with each measuring instrument and extending vertically from said machine frame for attachment of said measuring instrument, said pickup string being secured at a point of attachment to a pertaining said measuring carriage.

4. The machine of claim 3 wherein said points of attachment of said pickup strings to said measuring carriages extend at a same level with respect to a horizontal reference plane defined by a wheel contact area of said undercarriages.

5. The machine of claim 1 wherein said machine frame has a forward end and a rear end, and further comprising a second measuring means located on the forward end and the rear end of said machine frame for measuring a canting of the track.

6. A method of detecting errors of the track geometry in lateral direction by means of a track surfacing machine having a machine frame traveling on a track, comprising the steps of measuring the track geometry by means of measuring instruments which form with the machine frame a reference system, with the machine frame defining a reference base; and compensating zero adjustments of the measuring instruments in dependence on a cant of the track and a lining force for displacement of the track in a direction transversely to the track.

7. The method of claim 6, further comprising the step of compensating the zero adjustments in dependence on a twist of the machine frame.

* * * * *